United States Patent [19]

Lockwood, Jr. et al.

[11] 4,301,747

[45] Nov. 24, 1981

[54] HIGH TEMPERATURE FURNACE WITH IMPROVED SLAG TAP

[75] Inventors: Hanford N. Lockwood, Jr., San Mateo; Louis D. Siegert, Burlingame; Steven B. Brock, Palo Alto, all of Calif.

[73] Assignee: Coen Company, Inc., Burlingame, Calif.

[21] Appl. No.: 52,056

[22] Filed: Jun. 25, 1979

[51] Int. Cl.[3] ..... F23J 1/00

[52] U.S. Cl. ..... 110/171; 110/165 R

[58] Field of Search ..... 110/165 R, 171, 259; 432/67-71

[56] References Cited

U.S. PATENT DOCUMENTS

| | | | |
|---|---|---|---|
| 1,957,583 | 5/1934 | Foresman | 110/171 |
| 3,580,226 | 5/1971 | Blackburn et al. | 110/171 X |
| 3,589,317 | 6/1971 | Kunovits et al. | 110/171 |
| 3,741,136 | 6/1973 | Stookey | 110/171 X |
| 4,095,958 | 6/1978 | Caughey | 110/259 X |
| 4,227,469 | 10/1980 | Collura | 110/171 |

*Primary Examiner*—Edward G. Favors
*Attorney, Agent, or Firm*—Townsend and Townsend

[57] ABSTRACT

A furnace includes a downdraft combustion chamber, a burner mounted at the top of a combustion chamber for burning particulate ash-containing fuel, and a generally horizontal duct near the lower end of the combustion chamber for withdrawing hot gases rsulting from the combustion. The combustion chamber is downwardly tapered to a relatively small conduit, downward into which molten slag from the ash flows. The slag, upon passing through the conduit, passes into and through a downwardly open slag-receiving chamber below the combustion chamber. The slag falls through out the bottom of the slag-receiving chamber into a volume of water immediately below. A portion of the hot gases is diverted through the slag-receiving chamber in order to maintain the slag-receiving chamber at a sufficiently high temperature so that the slag passing therethrough is prevented from solidifying. The portion of hot gas is then directed to a mill for drying fuel therein prior to combustion.

30 Claims, 5 Drawing Figures

HIGH TEMPERATURE FURNACE WITH IMPROVED SLAG TAP

BACKGROUND OF THE INVENTION

The invention relates to a high temperature furnace for generating high temperature gases as are needed for use in such applications as soda ash processes, smelting, and drying. The invention is applicable to furnaces adapted to burn solid fuels having an ash content such as coal, dried sewage sludge and like materials.

It is well known that solid organic material such as coal typically contains inorganic minerals and the like to the extent of several percent of its weight. When the material is pulverized and burned, these inorganic minerals form a finely divided ash. At temperatures below 2,000° F., the ash is entrained in the gas stream in the form of particles which may be removed by conventional electrostatic precipitation methods. When the furnace is operated above 2,400° F., the ash becomes molten slag, precipitates on the furnace walls, and can be withdrawn through a tap in the bottom of the furnace so long as it is maintained at a sufficiently high temperature. If the slag is allowed to solidify prior to its removal from the furnace, the tap may become clogged, thereby necessitating shutdown of the furnace and costly repairs.

U.S. Pat. No. 3,947,001 shows an arrangement having a downdraft vertical furnace with a slag removal tap at the bottom. An auxiliary burner, typically gas or oil fired, maintains the slag in its molten state. Such a burner requires a second fuel capacity, which is inefficient, cumbersome, and expensive.

SUMMARY OF THE INVENTION

The invention provides an improved high temperature furnace which has enhanced operating characteristics and from which molten ash can be efficiently withdrawn. The removal of the slag is accomplished without the need of secondary burners, while at the same time, solidification of the slag and consequent clogging of the slag tap is avoided.

Broadly, the invention includes a downdraft combustion chamber, a burner mounted at the top of the combustion chamber for combusting pulverized coal or other organic material, and a generally horizontal duct near the lower end of the combustion chamber for withdrawing the hot gases resulting from the combustion. The burner is preferably of the type that mixes the fuel with air before the fuel enters the combustion chamber. The combustion chamber is lined with ruby brick in order to prevent damage from the molten slag which precipitates on the walls.

The lowermost portion of the combustion chamber is tapered to a relatively small conduit, downward into which the slag from the ash flows. The slag tap of the present invention includes a downwardly open slag-receiving chamber below the combustion chamber. The slag, upon passing through the conduit, passes into and through the slag-receiving chamber. The bottom opening of the slag-receiving chamber is preferably of larger horizontal dimensions than the conduit, so that the slag can fall through and out the bottom of the slag-receiving chamber without contacting the walls.

A volume of water is maintained immediately below the open bottom of the slag-receiving chamber, so that the slag passing through the slag-receiving chamber falls into the water and immediately solidifies. A fan withdraws steam and air from the space above the water to prevent them from entering into and cooling the slag-receiving chamber.

An annular plenum surrounds the slag-receiving chamber and communicates with it via a plurality of radially extending openings. Means is provided for evacuating the plenum to establish a flow of a portion of the hot furnace gases from the combustion chamber, through the slag-receiving chamber, into the plenum, and thence out of the plenum. The hot gases passing through and around the slag-receiving chamber thus heat the slag, the conduits, and the chamber sufficiently to maintain the slag passing therethrough in a molten state.

In addition, the hot gas travelling through the conduit leading into the slag-receiving chamber imparts additional downward velocity to the slag in the conduit. The gas slows down upon entering the slag-receiving chamber so that the radially outward flow of gas to the plenum does not convey the slag outward.

The hot gas collected from the plenum is withdrawn via an air duct and directed to a mill for drying the solid fuel before it is fed to the burner.

DESCRIPTION OF THE PREFERRED EMBODIMENTS

Figure 1:
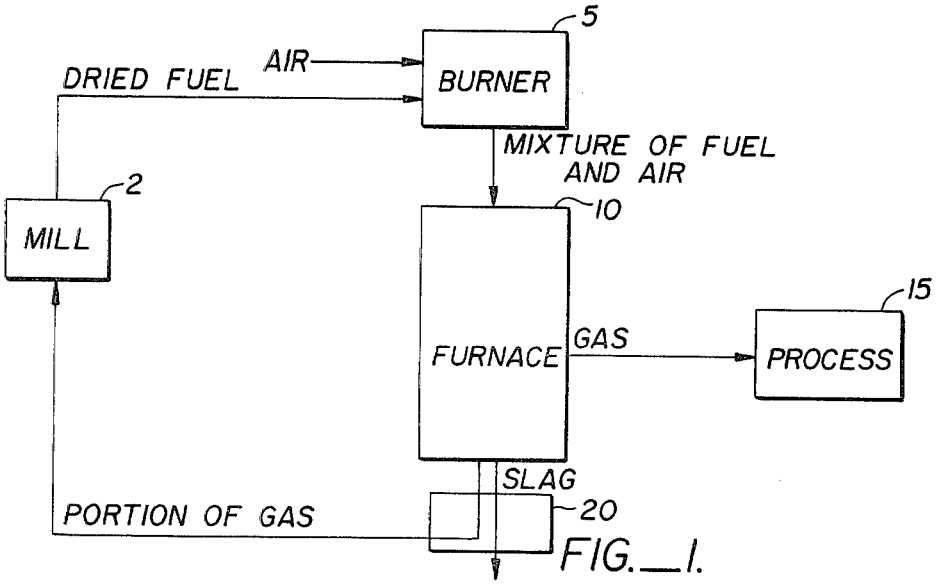
FIG. 1 is a block diagram illustrating the present invention.

FIG. 1 is a schematic block diagram illustrating the operation of a furnace and associated apparatus of the present invention. Ash-bearing fuel such as coal or sewage sludge is pulverized (if not already finely divided) and dried in a mill 2. The dried fuel is then mixed with air in a burner 5, and the mixture burned in a furnace 10 at a sufficiently high temperature to cause the ash to form a molten slag. The bulk of the hot furnace gases from the combustion is withdrawn for use in a process 15 requiring the gases.

The slag runs down the sides of furnace 10 and passes out through slag tap 20. A small portion of the hot gases is also withdrawn through slag tap 20 in order to prevent solidification and clogging. This portion of hot gases is then passed to mill 2 for drying the fuel therein.

Figure 2:
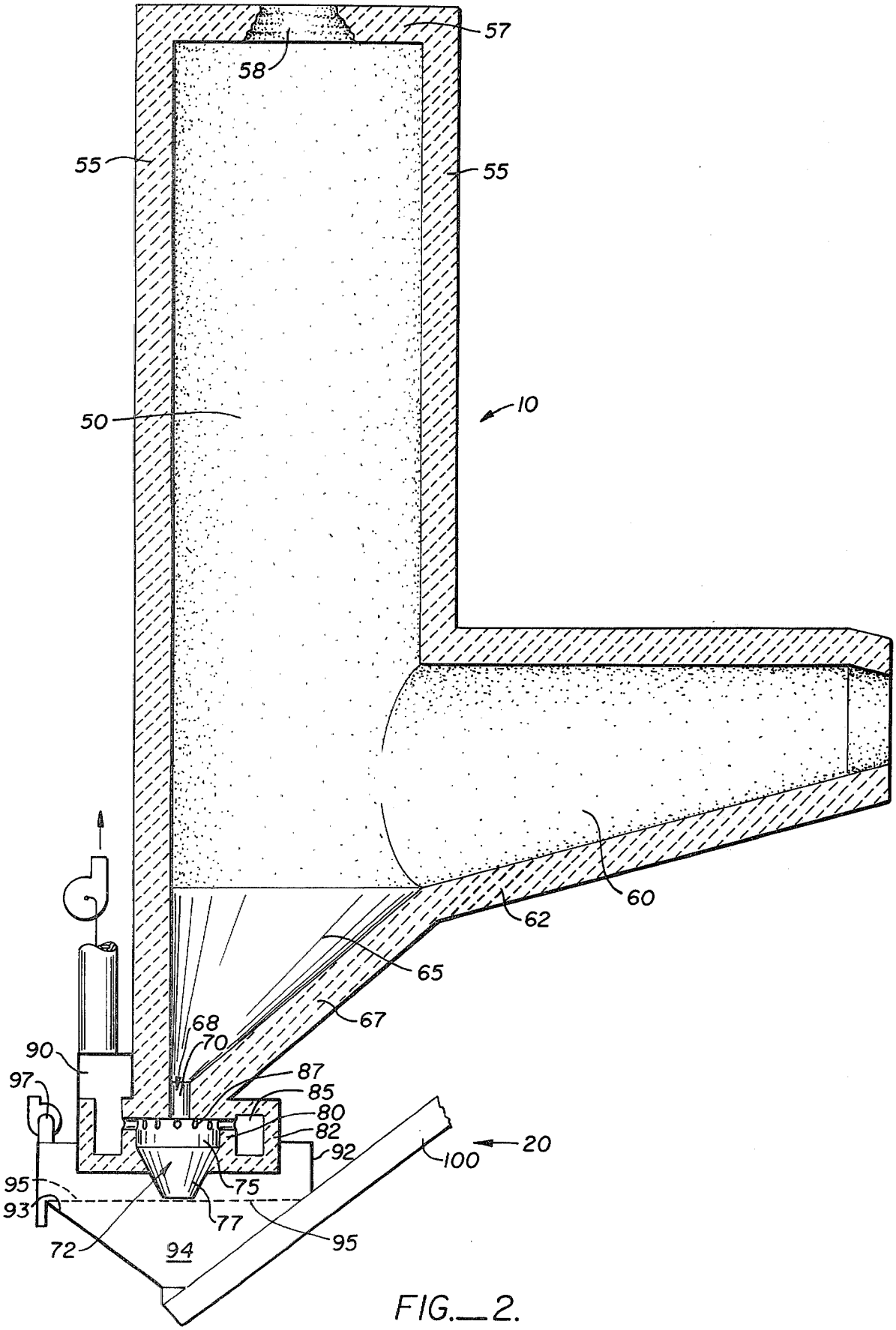
FIG. 2 is a sectional view of a vertical downfired furnace and slag tap constructed according to the present invention.

Referring to FIG. 2, furnace 10 comprises a generally vertical combustion chamber 50 having a generally cylindrical configuration defined by wall 55. Wall 55 is preferably lined with ruby brick in order to prevent damage due to slag precipitating on and running down the sides of the chamber. The top of the combustion chamber is defined by top wall 57, having a central aperture 58 to define a burner throat. A generally horizontal duct 60 joins combustion chamber 50 near its lower end for withdrawal of the hot furnace gases. Duct 60 includes a lower inclined wall 62 which slopes downwardly.

The lowermost portion 65 of furnace 10 is tapered to a funnel-like configuration including lower inclined wall 67, which extends across the bottom of combustion chamber 50 and is contiguous with inclined wall 62 of horizontal duct 60. Tapered portion 65 defines a relatively narrow opening 68 at the bottom which communicates to a downwardly extending vertical conduit 70. As illustrated, opening 68 and conduit 70 are off-center, being adjacent a vertical wall of furnace 10. If desired, portion 65 can be given a frustoconical shape around a vertical axis to align opening 68 and conduit 70 with the centerline of combustion chamber 50.

Figure 3:
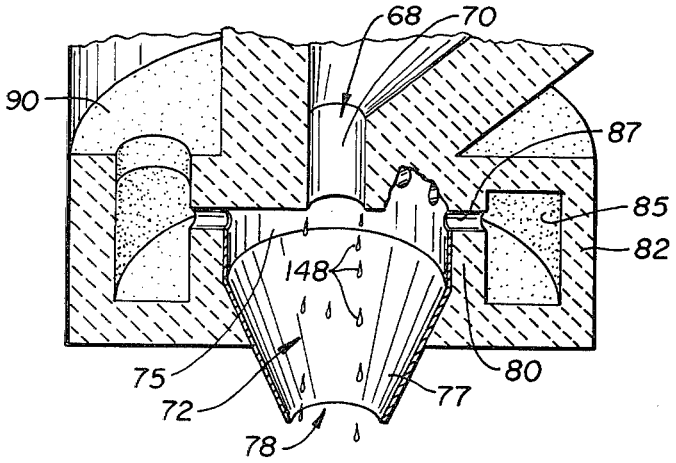
FIG. 3 is an enlarged perspective sectional view of the slag tap of the present invention.

Referring also to FIG. 3, slag tap 20 includes a slag-receiving chamber 72 in fluid communication with combustion chamber 65 via conduit 70. Slag-receiving chamber 72 has an upper cylindrical portion 75 and a lower frustoconical wall 77 directly underlying and contiguous with portion 75. The lower wall defines an opening 78 at its bottom which has a transverse dimension greater than that of downwardly extending conduit 70 so that slag passing through the conduit can pass through opening 78 without contacting wall 77.

Wall 80 surrounding slag-receiving chamber 72 is itself surrounded by a spaced cylindrical wall 82 to define a circumscribing annular plenum 85 of rectangular cross-section. A plurality of radially extending apertures 87 extend through wall 80, preferably at a point as high as possible, to establish fluid communication between slag-receiving chamber 72 and plenum 85. A duct 90 communicates with plenum 85 to permit the evacuation thereof by a fan 91.

Directly underlying slag-receiving chamber 72 is a generally closed, downwardly tapered water bath 92. A weir 93 maintains water 94 at a level 95 immediately below opening 78 of slag-receiving chamber 72. A fan 97 has an intake communicating with the interior of water bath 92 above water level 95. A conveyor 100 is provided for removing solid material, i.e. solidified slag out of bath 92.

Figure 4:
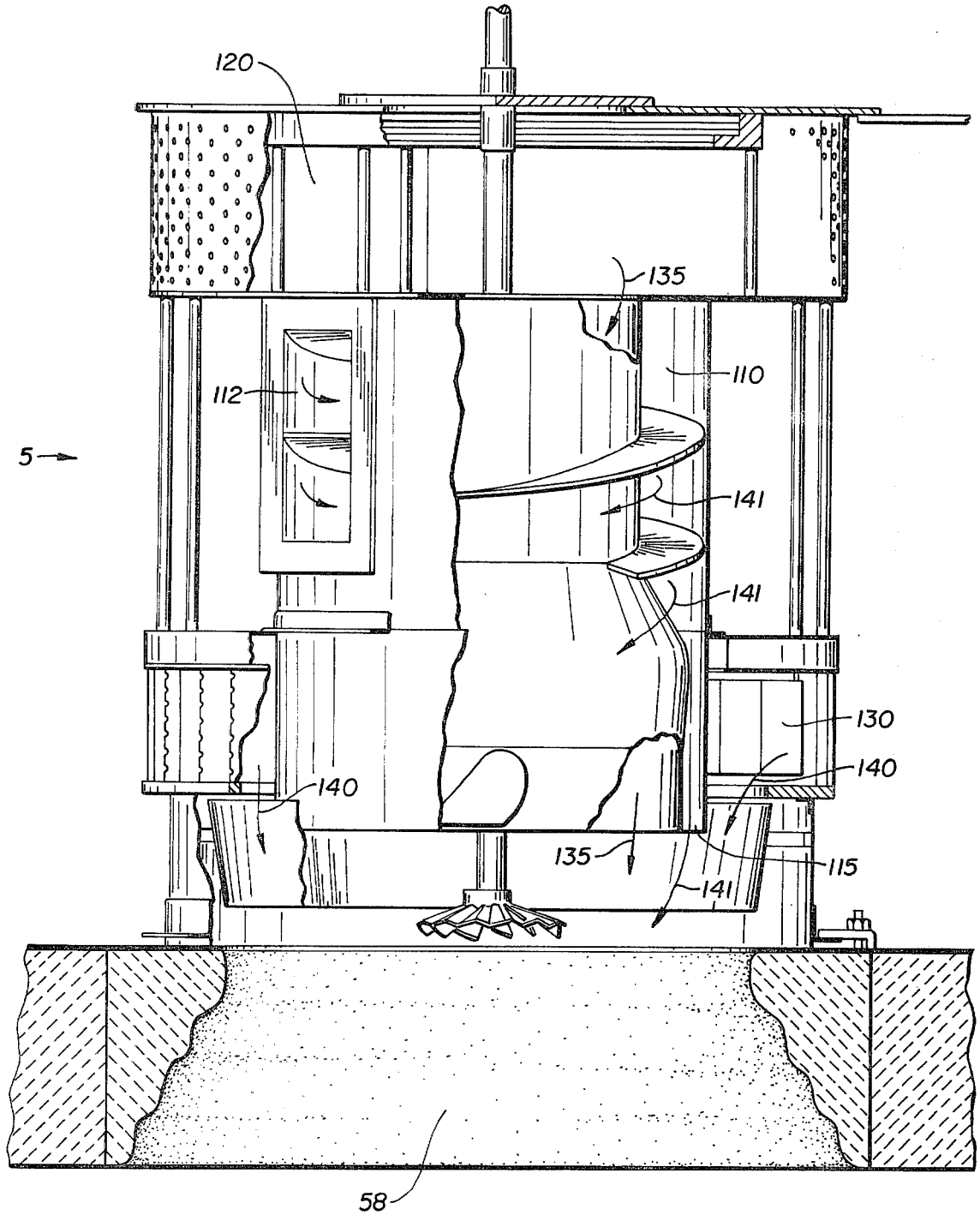
FIG. 4 is a simplified view of a burner suitable for use in the furnace of the present invention.

FIG. 4 is a simplified cutaway view of a presently preferred burner. Many of the structural details of the burner are set forth in the commonly owned U.S. Pat. No. 3,391,981. Broadly, burner 5 comprises a scroll-shaped fuel chamber 110 for receiving airborne pulverized fuel and providing cyclone acceleration thereto, a core air zone register 120, and an annular air zone register 130. Scroll-shaped chamber 110 has an inlet 112 at one end, and opens to annulus 115 at its other end in the region generally bounded by burner throat 58. Due to the abrasive nature of some fuels (e.g. pulverized coal), it may be necessary to provide a ceramic lining for fuel chamber 110.

While the detailed structure and operation of such a burner are set forth in the above-referenced U.S. patent, a brief summary of the operation of the burner is set forth herein. Core zone register 120 provides an inner core of rapidly moving air which moves downward with a helical motion indicated by arrows 135. Annulus air zone register 130 provides an outer annular layer of rapidly moving air denoted by arrows 140. Core zone register 120 and annular air zone register 130 preferably impart helical motions to their respective volumes of air that are in opposite sense. Pulverized fuel is fed to fuel inlet 112 and is accelerated helically within chamber 110 as denoted by arrows 141. It is then injected from annulus 115 between the core air and the annular air. The injection of the fuel between the oppositely rotating zones of a rapidly moving air promotes turbulence and improves mixing. The mixture is then ignited for combustion in combustion chamber 50.

Having set forth the structure of the apparatus, the operation of the furnace and slag tap can be described. The combustion of fuel in chamber 50 at temperatures above the melting point of the ash content causes molten ash (slag) to precipitate on wall 55. The slag runs down wall 55 and is directed by tapered lower portion 65 through opening 68 and into conduit 70. A portion of the slag that remains entrained in the hot furnace gases as they pass through duct 60 precipitates on duct 60 and runs down lower inclined wall 67 into tapered lower portion 65. It is estimated that approximately 75% or more of the ash content of the fuel precipitates out of the furnace gases in the form of slag, thereby avoiding the necessity of removal by other means. If process 15 requires a lower ash content in the gas, further ash removal means, e.g., a cyclone, may be provided.

Fan 91 in duct 90 evacuates plenum 85 and transports the gas to mill 2. This causes a small portion of the hot furnace gases (typically 2–10% and more often 3–5%) to be drawn through conduit 70 into slag receiving chamber 72. The portion of the gas then passes through apertures 87, into plenum 85, and then out duct 90. The diversion of a portion of the hot furnace gases maintains slag receiving chamber 72, and more particularly, the region surrounding and including conduit 70 at about the temperature of combustion chamber 50, i.e. at a temperature above the melting point of the ash, so that the slag passing therethrough does not solidify and clog up the conduit. Slag running into conduit 70 then falls in the form of droplets 148 or a slag stream through slag receiving chamber 72, and out bottom opening 78 as is shown in FIG. 3. Since bottom opening 78 is wider than the transverse dimension of conduit 70, most or all of the slag falls directly through the chamber without contacting the internal portions thereof. Any slag that nevertheless splatters on the inner surface of the wall 80 is directed to bottom opening 78 by the tapered portion defining frustoconical wall 77.

The hot gas passing through conduit 70, in addition to maintaining the slag therein molten, tends to increase the downward velocity of the slag. However, upon entering slag-receiving chamber 72 which is wide compared to conduit 70 the gas slows down. This slowdown reduces the tendency of the gas to entrain the downwardly falling slag as the gas moves radially outward. Moreover, the location of apertures 87 at the top of wall 80 is well out of the path of the falling slag to further minimize the chance of slag being swept out of chamber 72 through apertures 87.

The slag falling through bottom opening 78 falls into water 94, where it solidifies and conveyor 100 withdraws the solidified material from the bottom of bath 92. Fan 97 maintains the volume above water level 95 at a lower pressure than the pressure in the slag-receiving chamber to withdraw air and steam and to prevent them from entering through opening 78 into the slag-receiving chamber.

The hot gas that passes through duct 90 is then used to dry fuel in mill 2. The particular configuration of mill 2 is not a part of the present invention, but rather is chosen for the particular application. Thus, if a fuel that is already in a finely divided form is used, mill 2 will comprise only a dryer. On the other hand, if the fuel is coal, which must be pulverized, a conventional coal mill is employed. Such a coal mill may be a standard item of manufacture such as a bowl mill manufactured by C. E. Raymond, Chicago, Illinois (a division of Combustion Engineering Corp.) or a ball mill manufactured by Kennedy Van Saun Corp., Danville, Pennsylvania.

Figure 5:
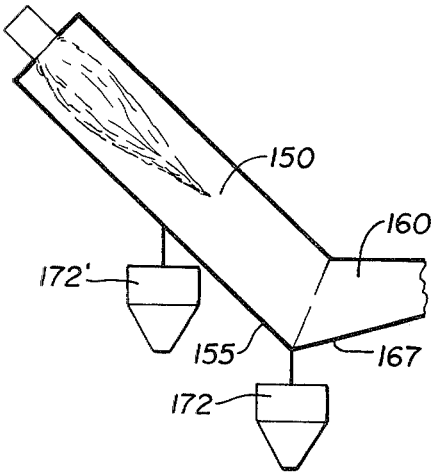
FIG. 5 is a schematic of an inclined furnace with multiple slag taps.

While the above discussion and description were generally directed to a vertically oriented, downfired furnace, with a single slag tap, the invention is not so limited. An adaptation that is within the spirit of the present invention is illustrated schematically in FIG. 5. Combustion chamber 150 is inclined, and has lower inclined wall 155. Hot gases are withdrawn through duct 160 which preferably has a lower inclined wall 167 sloping back toward combustion chamber 150. Lower inclined wall 155 of combustion chamber 150 and lower inclined wall 167 of duct 160 thus define a funnel-like structure that communicates to a slag tap 172, shown schematically. A second slag tap 172 may be provided at a position along inclined wall 155 intermediate burner 152 and slag-tap 172.

We claim:

1. In a high temperature furnace for generating hot gases by combusting an ash-bearing fuel, the furnace including a combustion chamber, a burner near one end of the combustion chamber for generating the hot gases and a duct near the other end of the combustion chamber through which the hot gases pass out of the combustion chamber, the temperature of the gases being sufficiently high to melt ash in the fuel to form molten slag, an improved slag tap into which slag flows comprising:

means defining a downwardly open slag-receiving chamber disposed below a portion of and in flow communication with the combustion chamber; and means for actively withdrawing a sufficient portion of the hot gases from the combustion chamber into the slag-receiving chamber and for heating slag passing through the slag-receiving chamber sufficiently with the portion of the hot gases to maintain such slag in its molten state, thereby preventing it from solidifying while in the slag-receiving chamber.

2. The invention of claim 1 wherein the withdrawing and heating means includes means for passing the portion of hot gases through the slag-receiving chamber.

3. The invention of claim 2 wherein the withdrawing and heating means also comprises:

means defining a plenum surrounding the slag-receiving chamber;

means defining a plurality of openings between the plenum and the slag-receiving chamber; and means for evacuating the hot gas from the plenum;

such that the portion of hot gases passes from the combustion chamber, into the slag-receiving chamber, through the openings, and into the plenum, thereby heating the slag-receiving chamber and slag passing therethrough.

4. The invention of claim 1 also comprising means for maintaining a volume of water substantially immediately below the slag-receiving chamber, whereby slag passing through the slag-receiving chamber falls into the water and solidifies.

5. The invention of claim 1 wherein the combustion chamber is vertical and is tapered at its bottom to direct slag into the slag-receiving chamber.

6. In a high temperature, furnace for generating hot gases from the combustion of particulate organic material, the material having an ash content, the gases having a temperature above the melting temperature for the ash so that the ash is transformed into molten slag while in the furnace, the furnace including a combustion chamber having first and second ends, a burner near the first end of the combustion chamber for introducing the material into the chamber, means for supplying combustion air, and a duct near the second end of the combustion chamber for withdrawing the hot gases, an improved slag tap into which the slag passes comprising:

means defining a slag-receiving chamber below the combustion chamber, the slag-receiving chamber defining a downwardly open hole at its bottom;

means defining a conduit communicating the combustion chamber with the slag-receiving chamber;

means for maintaining a volume of water substantially immediately below the slag-receiving chamber;

wherein slag generated in the chamber flows through the conduit, through the slag-receiving chamber, and into the water where it solidifies;

means defining openings communicating the slag-receiving chamber with the exterior; and means for withdrawing gas from the slag-receiving chamber through the openings;

such that a portion of the hot gases in the combustion chamber is drawn through the conduit, into the slag-receiving chamber, and hence through the openings to the exterior of the slag-receiving chamber to thereby maintain the temperature of the slag-receiving chamber at about the level of the temperature in the combustion chamber and the slag passing therethrough in a molten state.

7. A furnace according to claim 6 including means disposed exteriorly of the slag-receiving chamber and in fluid communication with the openings for collecting gas withdrawn through the latter.

8. A furnace according to claim 7 wherein the collecting means comprises an annular plenum surrounding the slag-receiving chamber.

9. The invention of claim 8 wherein the plenum has a rectangular cross-section, and wherein the means defining the openings comprises a common wall between the slag-receiving chamber and the plenum, and wherein the openings extend generally through the wall radially.

10. The invention of claim 6 wherein the combustion chamber is lined with ruby brick.

11. The invention of claim 6 also comprising a fan disposed proximate the bottom opening of the slag-receiving chamber for withdrawing steam and air from the space above the water level to prevent entry of the steam and air into the slag-receiving chamber.

12. The invention of claim 6 in which the hole at the bottom of the slag-receiving chamber is of larger horizontal dimensions than the horizontal dimensions of the conduit communicating the combustion chamber with the slag-receiving chamber, such that a major portion of the slag passing through the conduit into the slag-receiving chamber drops through the hole without contacting the inner surfaces of the slag-receiving chamber.

13. The invention of claim 6 in which the burner is a pulverized coal burner.

14. The invention of claim 13 also comprising a coal mill for drying coal, means for directing the gas withdrawn from the slag-receiving chamber to the coal mill, and means for drying coal in the mill with such withdrawn hot gases.

15. The invention of claim 6 including means for mixing the organic material with air before the material is introduced into the chamber.

16. The invention of claim 15 wherein the means for mixing is defined by the burner, and wherein the burner comprises means for imparting a helical motion to the mixture of coal and air prior to their introduction into the combustion chamber.

17. Apparatus for generating hot gases from the combustion of ash-bearing organic material comprising:

a vertical combustion chamber having an upper portion and a lower portion, the lower portion being tapered to define a relatively small opening at the bottom;

a burner for combusting dried pulverized organic material, mounted above the upper portion of the combustion chamber;

a generally horizontal first duct below the upper portion of the combustion chamber for withdrawing from the combustion chamber the hot gases resulting from the combustion;

means at the bottom of the combustion chamber defining a generally vertical passageway extending from the opening;

a first generally cylindrical wall defining a slag-receiving chamber below the combustion chamber and in fluid communication with the opening, the slag-receiving chamber having a diameter at its top that is larger than the transverse dimensions of the vertical passageway, the wall having a plurality of apertures extending radially therethrough, the slag-receiving chamber being tapered at its bottom, and being open at its bottom;

a second coaxial wall having an inner diameter greater than the outer diameter of the first coaxial wall, thereby defining an annular plenum between the first and second walls;

means for maintaining a volume of water beneath the opening in the bottom of the slag-receiving chamber;

a mill adapted to supply dried pulverized material to the burner;

a second duct leading from the plenum to a mill; and means for causing gas within the plenum to flow through the second duct to the coal mill and for drying organic material therein with such gas;

wherein slag from the burning material in the combustion chamber passes through the passageway, into the slag-receiving chamber, and therethrough into the water where it solidifies while a portion of the hot gases passes through the passageway, into the slag-receiving chamber, radially outward through the radially extending apertures, into the plenum, into the second duct, and into the mill, and the hot gases maintain the slag-receiving chamber and the slag therein at a temperature approximating that of the combustion chamber to prevent the slag from solidifying before reaching the water.

18. The invention of claim 17 wherein the opening at the bottom of the slag-receiving chamber is larger than the vertical passageway for enabling slag passing through the passageway to free-fall through the slag-receiving chamber into the water.

19. The invention of claim 17 wherein the slag-receiving chamber has an upper cylindrical portion and a lower frustoconical portion and wherein the radially extending apertures extend through the first cylindrical wall at an upper portion of the upper cylindrical portion such that the portion of hot gases slows down upon entering the slag-receiving chamber, whereby entrainment of the slag in the slag-receiving chamber by the radially outflowing gases is minimized.

20. The invention of claim 17 wherein the combustion chamber is lined with ruby brick and wherein the first duct is located immediately above the tapered lower portion of the combustion chamber.

21. A high temperature furnace for generating hot gases from the combustion of particulate organic matter comprising:

a combustion chamber having an upper portion and a lower portion, the combustion chamber having a lower inclined wall extending between the portions;

a burner for combusting dried pulverized organic matter mounted at the upper portion of the combustion chamber;

a duct at the lower portion of the combustion chamber for withdrawing the hot gases; and at least one slag tap disposed along the lower inclined wall, the slag tap comprising means defining an opening in the lower inclined wall, means defining a generally vertical passageway extending from the opening, means defining a slag-receiving chamber below the passageway and in communication with the combustion chamber via the passageway, means defining an annular plenum surrounding the slag-receiving chamber, means between the slag-receiving chamber and the plenum for providing gas communication therebetween, and means for withdrawing gas from the plenum, such that a portion of the hot gases is withdrawn through the passageway, into the slag-receiving chamber, through the openings, into the plenum, and out the plenum, thereby maintaining the temperature of the slag-receiving chamber at a temperature approximately that of the combustion chamber, whereby the slag is prevented from solidifying.

22. The invention of claim 21 including at least first and second slag taps, the openings in the lower inclined wall for the first and second slag taps being at different elevations along the lower inclined wall.

23. In a process for generating hot gases including the step of burning pulverized ash-bearing organic material in a combustion chamber, the gases having a sufficient temperature to melt the ash and form a slag so that at least a portion of the slag precipitates out of the gas stream, the improvement comprising the steps of:

providing a downwardly open slag-receiving chamber beneath and communicating with the combustion chamber;

passing the slag into and through the slag-receiving chamber;

withdrawing a predetermined portion of the hot gases; and heating the slag passing through the slag-receiving chamber with the portion of hot gases sufficiently to maintain the slag in its molten state while disposed within the open chamber;

whereby the slag is prevented from solidifying until after it has passed through a portion of the slag-receiving chamber.

24. The process of claim 23 also including the step, performed after heating the slag in the slag-receiving open chamber, of directing the portion of hot gases to a mill for drying organic material prior to combustion of the organic material.

25. The process of claim 23 wherein the step of passing the slag into and through the slag-receiving chamber includes the steps of providing a vertical conduit between the combustion chamber and the slag-receiving chamber, flowing the slag through the conduit, and gravitationally releasing the slag in the slag-receiving chamber, whereby a major portion of the slag free-falls through the slag-receiving chamber and out the downward opening thereof.

26. In a high temperature furnace for generating hot gases by combusting an ash-bearing fuel, the furnace including a combustion chamber, a burner near one end of the combustion chamber for generating the hot gases, and a duct near the other end of the combustion chamber through which the hot gases pass out of the combustion chamber, the temperature of the gases being sufficiently high to melt ash in the fuel to form molten slag, an improved slag tap into which slag flows comprising:

means defining a downwardly open slag-receiving chamber disposed below a portion of and in flow communication with the combustion chamber; and means for withdrawing a portion of the hot gases from the combustion chamber and for heating slag passing through the slag-receiving chamber sufficiently with the portion of the hot gases to maintain such slag in its molten state, thereby preventing it from solidifying while in the slag-receiving chamber, the withdrawing and heating means including means for passing the portion of hot gases through the slag-receiving chamber, means defining a plenum surrounding the slag-receiving chamber, means defining a plurality of openings between the plenum and the slag-receiving chamber, and means for evacuating the hot gas from the plenum, whereby the portion of hot gases passes from the combustion chamber, into the slag-receiving chamber, through the openings, and into the plenum, thereby heating the slag-receiving chamber and slag passing therethrough.

27. The invention of claim 26 also comprising means for maintaining a volume of water substantially immediately below the slag-receiving chamber, whereby slag passing through the slag-receiving chamber falls into the water and solidifies.

28. The invention of claim 26 wherein the combustion chamber is vertical and is tapered at its bottom to direct slag into the slag-receiving chamber.

29. In a process for generating hot gases including the step of burning pulverized ash-bearing organic material in a combustion chamber, the gases having a sufficient temperature to melt the ash and form a slag so that at least a portion of the slag precipitates out of the gas stream, the improvement comprising the steps of:

providing a downwardly open slag-receiving chamber beneath and communicating with the combustion chamber;

passing the slag into and through the slag-receiving chamber;

withdrawing a portion of the hot gases;

heating the slag passing through the slag-receiving chamber with the portion of hot gases sufficiently to maintain the slag in its molten state while disposed with the open chamber;

whereby the slag is prevented from solidifying until after it has passed through a portion of the slag-receiving chamber; and directing the portion of hot gases to a mill for drying organic material prior to combustion of the organic material.

30. The process of claim 29 wherein the step of passing the slag into and through the slag-receiving chamber includes the steps of providing a vertical conduit between the combustion chamber and the slag-receiving chamber, flowing the slag through the conduit, and gravitationally releasing the slag in the slag-receiving chamber, whereby a major portion of the slag free-falls through the slag-receiving chamber and out the downward opening thereof.

* * * * *